United States Patent [19]

Yokota et al.

[11] Patent Number: 4,809,384

[45] Date of Patent: Mar. 7, 1989

[54] HORIZONTALLY MOVING AUTOMATIC OUTER SURFACE CLEANING

[75] Inventors: Teruo Yokota; Yoshihiro Nishiyama; Tadao Takasaki, all of Tokyo, Japan

[73] Assignee: Nihon Biso Kabushiki Kaisha, Tokyo, Japan

[21] Appl. No.: 18,022

[22] Filed: Feb. 24, 1987

[51] Int. Cl.[4] ..... A47L 1/00

[52] U.S. Cl. ..... 15/103; 15/98; 15/302; 15/50 R

[58] Field of Search ..... 15/50 R, 50 C, 98, 103, 15/312 R, 302; 104/121

[56] References Cited

U.S. PATENT DOCUMENTS

| | | | |
|---|---|---|---|
| 3,425,082 | 2/1969 | Hetman | 15/103 X |
| 3,497,902 | 3/1970 | Hartigan | 15/103 X |
| 3,795,930 | 3/1974 | Leifheit | 15/50 C |
| 3,895,406 | 7/1975 | Fannon, Jr. | 15/302 |
| 3,942,450 | 3/1976 | Elorza | 104/121 |
| 4,025,984 | 5/1977 | Hoener | 15/302 |
| 4,136,419 | 1/1979 | Hetman | 15/312 R X |
| 4,198,724 | 4/1980 | Fisher et al. | 15/302 |

*Primary Examiner*—Philip R. Coe
*Assistant Examiner*—K. L. O'Leary
*Attorney, Agent, or Firm*—Hedman, Gibson, Costigan & Hoare

[57] ABSTRACT

A horizontally moving automatic outer surface cleaning apparatus comprising horizontal rails provided above and below a surface to be cleaned such as a window glass and a carrier having engaging means for engaging with the horizontal rails for enabling the carrier to be guided along the rails. On the carrier, there are mounted drive means for driving the carrier to move along the horizontal rails, water spray means for spraying water over the surface to be cleaned, wiper means for cleaning the surface by wiping the surface and a soiled water tank containing soiled water collected as a result of wiping by the wiper means. In a preferred embodiment, the carrier consists of a main carrier and a work carrier coupled to the main carrier in such a manner that the carrier can move along a curved portion which can be formed in the horizontal rails.

11 Claims, 5 Drawing Sheets

HORIZONTALLY MOVING AUTOMATIC OUTER SURFACE CLEANING

BACKGROUND OF THE INVENTION

This invention relates to an apparatus for automatically cleaning outer surfaces of a building such as a window glass and a wall surface by horizontally moving along such outer surface and, more particularly, to an apparatus of such type particularly suited for cleaning a horizontally continuous outer surface such as a horizontally continuous window glass.

For performing cleaning of a window glass of a multistoried building safely and efficiently, various automatic window cleaning apparatus have been proposed and used. In use, these cleaning apparatus are usually suspended from a roof car or the like device disposed on the roof of the building by means of a wire.

For performing the cleaning work, the prior art automatic window cleaning apparatus is successively lowered vertically from a window of the uppermost floor towards the ground for cleaning a window of each story successively and, after finishing cleaning of a window of the ground floor, the cleaning apparatus is lifted to the uppermost floor and then moved horizontally to a next window of the uppermost floor to reiterate the above cleaning operation from the uppermost floor down to the ground floor.

Such prior art automatic window cleaning apparatus is effective when it is used on windows which are continuously formed in the vertical direction of a building because these vertically continuous windows can be cleaned very effectively by preadjusting the width of the cleaning apparatus to the width of the windows.

It is a recent tendency in the building design, however, to design a building with horizontally continuous windows which are continuously formed horizontally on the same floor but are discontinuous between vertically adjacent floors. The above described prior art window cleaning apparatus which are adapted to move in the vertical direction are incapable of approaching the window glass surface if there is a portion of the building which is projecting between vertically adjacent windows and, accordingly, cleaning of the window glass must be done by a hand work.

For achieving cleaning of such horizontally continuous windows by using the prior art window cleaning apparatus adapted to move vertically, it is conceivable to move the prior art window cleaning apparatus horizontally by horizontally moving the roof car from which the apparatus is suspended. This concept, however, is unworkable because, if such cleaning apparatus suspended from the roof car by wire rope is moved horizontally, such horizontal moving will be accompanied by a great sway of the apparatus with resulting difficulty in realizing smooth horizontal moving of the apparatus and accomplishment of the intended cleaning work. The longer the wire suspending the cleaning apparatus, the greater will be this difficulty.

If the prior art cleaning apparatus is used for a building in which windows are horizontally continuous, there arise a further problem that it is extremely difficult to clean corner portions of the building.

It is, therefore, an object of the invention to provide a horizontally moving automatic outer surface cleaning apparatus capable of realizing cleaning of a window glass effectively and smoothly even if windows are horizontally continuous ones.

SUMMARY OF THE INVENTION

According to the invention, there is provided a horizontally moving automatic outer surface cleaning apparatus which is characterized in that it comprises horizontal rails provided above and below a surface to be cleaned, a carrier having engaging means for engaging with said horizontal rails for enabling said carrier to be guided along said rails, drive means mounted on said carrier for driving said carrier to move along said horizontal rails, water spray means mounted on said carrier for spraying water over said surface to be cleaned, wiper means mounted on said carrier in the rear of said water spray means in the moving direction of said carrier for cleaning said surface by wiping said surface, and a soiled water tank mounted on said carrier and containing soiled water collected as a result of wiping by said wiper means.

According to the invention, the carrier mounted with the water spray device and wiper device is moved horizontally along the horizontal rails and the outer surface of architecture is cleaned by spraying water on the outer surface by the water spray device and wiping off the soiled water by the wiper device. Thus, a horizontally continuous outer surface such as a horizontally continuous window glass can be automatically cleaned continuously and smoothly.

Since the cleaning apparatus is moved with its upper and lower end portions restricted by the upper and lower horizontal rails, the cleaning apparatus can perform the automatic cleaning work without being affected by weather conditions such as wind so that the cleaning work can be achieved effectively as scheduled. Besides, since the cleaning work on a multistoried building can be performed automatically, safety in the cleaning work is ensured.

Further, since the cleaning apparatus according to the invention does not require an apparatus including a roof car and wire for suspending the cleaning apparatus as in the prior art cleaning apparatus, the structure of the cleaning apparatus can be made simple and compact with resulting reduction in the manufacturing cost and easiness in handling and maintenance of the cleaning apparatus.

According to one aspect of the invention, the carrier consists of the main carrier and the work carrier coupled to each other whereby the cleaning apparatus can be moved horizontally along a curved corner of the architecture so that the automatic cleaning can be performed with high efficiency along the entire periphery of the architecture.

BRIEF DESCRIPTION OF THE DRAWINGS

In the accompanying drawings.

DESCRIPTION OF A PREFERRED EMBODIMENT

Figure 1:
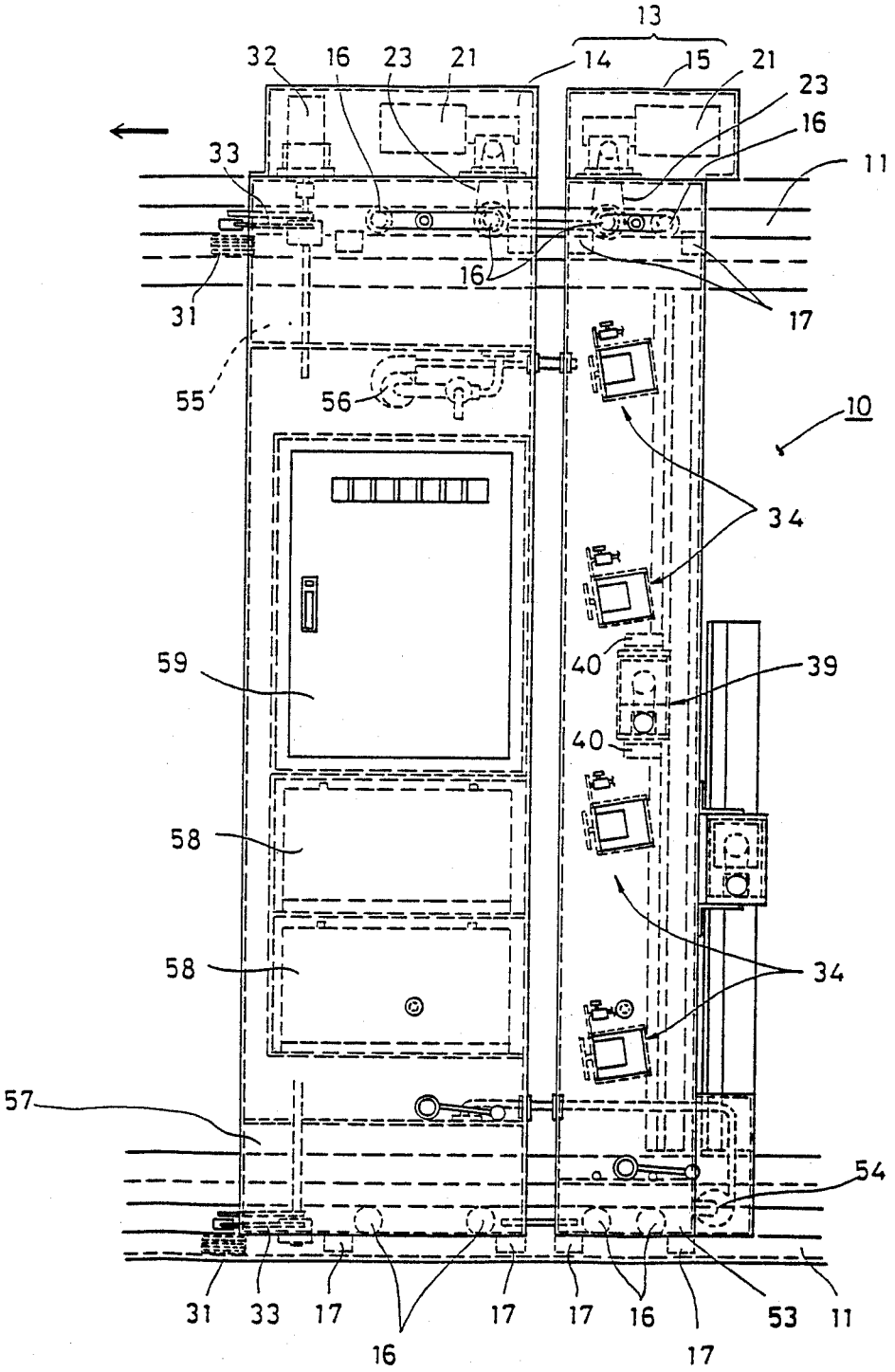
FIG. 1 is a front view of an embodiment of the horizontally moving outer surface cleaning apparatus according to the invention.

With reference to the accompanying drawings, a preferred embodiment of the horizontally moving automatic outer surface cleaning apparatus will be described.

Horizontal rails 11 are disposed along the upper and lower edges of a window glass 10 which is a surface to be cleaned and mounted on a building 12 integrally with a window frame. The rails 11 are made of channel bars with lip portions 11*a*.

A horizontally moving carrier 13 guided horizontally along the horizontal rails 11 consists of a main carrier 14 which is a leading carrier in the running direction of the carrier and a work carrier 15 which is coupled to the main carrier 14. The carrier 13 is disposed vertically opposite to the window glass 10.

The main carrier 14 and the work carrier 15 are respectively provided with two pairs of running rollers 16 which roll along the lip portions 11*a* of the horizontal rails 11 and guide rollers 17 which engage in channels 11*b* of the horizontal rails 11 for guiding the carriers 14 and 15 along the horizontal rails 11.

Figure 3A:
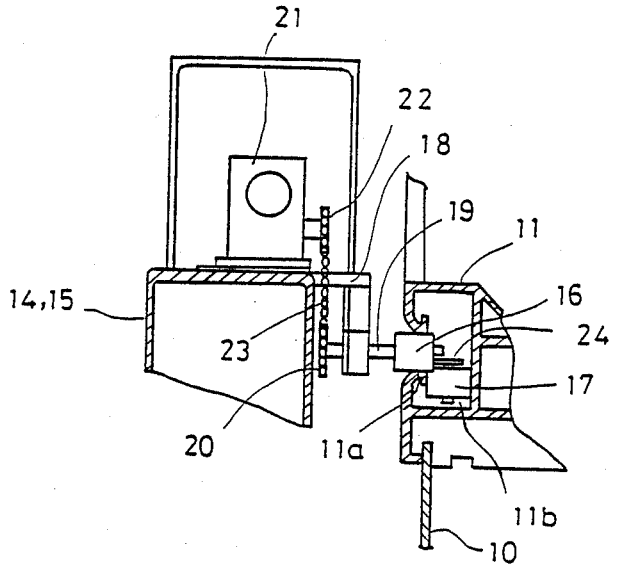
FIGS. 3A and 3B are enalrged views of running wheels.

As shown in an enlarged scale in FIG. 3A, bearings 80 are mounted on brackets 18 which are welded to the front upper end portion of each of the carriers 14 and 15 and the running rollers 16 are secured to rotation shafts 19 supported by the bearings 80. One of the two rotation shafts 19 is provided at its base portion with a sprocket 20. A sprocket 22 is provided also on a rotation shaft of a running drive motor 21 mounted on the top surface of each of the carriers 14 and 15 and a chain 23 is provided between these sprockets 20 and 22 to transmit the rotational force of the motor 21 to the running rollers 16.

Horizontally projecting brackets 24 are welded to the front portion of each of the carriers 14 and 15 and the guide rollers 17 are rotatably supported on vertical shafts secured to these brackets.

Figure 3B:
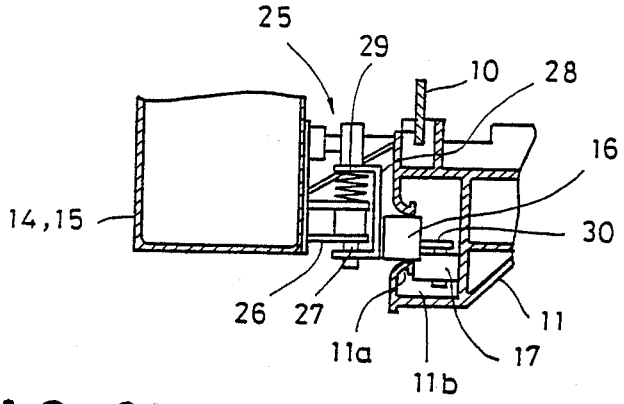

On the other hand, as shown in an enlarged scale in FIG. 3B, the running rollers 16 and the guide rollers 17 provided in the lower portion of the carriers 14 and 15 comprise suspensions 25 so as to enable the running rollers 16 to roll smoothly complying with a slight change in the horizontal rails 11. In each suspension, a vertical support rod 27 is mounted vertically displaceably on a bracket 26 projecting forwardly of the carrier 14 or 15 and a channel-bar shaped support frame 28 is secured to the support rod 27 in such a manner that the support frame 28 encloses the bracket 26. A coil spring 29 is provided between the bracket 26 and the support frame 28.

The running roller 16 is rotatably mounted on a horizontal shaft projecting forwardly from the front surface of the support frame 28 and the guide roller 17 is rotatably supported on a vertical shaft secured to a horizontally projecting bracket 30 secured to the carrier 14 or 15. A slight variation in the interval in tee lip portion 11*a* of the horizontal rail 11 is absorbed by vertical movement of the support rod 27 against force of the coil spring 29.

In the upper and lower front portion of the main carrier 14 which is the foremost end portion of the carrier 13 in the running direction (leftside as viewed in FIG. 1), there are provided rotary brushes 31 at positions corresponding to the channels 11*b* of the horizontal rails 11 for removing dusts or the like in the channles 11*b* and thereby ensuring smooth running of the carrier 14. The rotary brushes 31 are of a size corresponding to the width of the channels 11*b* of the horizontal rails 11 and are driven by a brush drive motor 32 mounted in the upper portion of the carrier 14 via the chain 33.

Water spray devices 34 mounted on the work carrier 15 will now be described.

Figure 4:
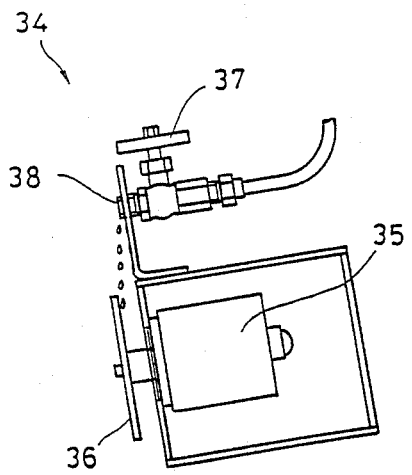
FIG. 4 is a front view of a water spray device.
Figure 5:
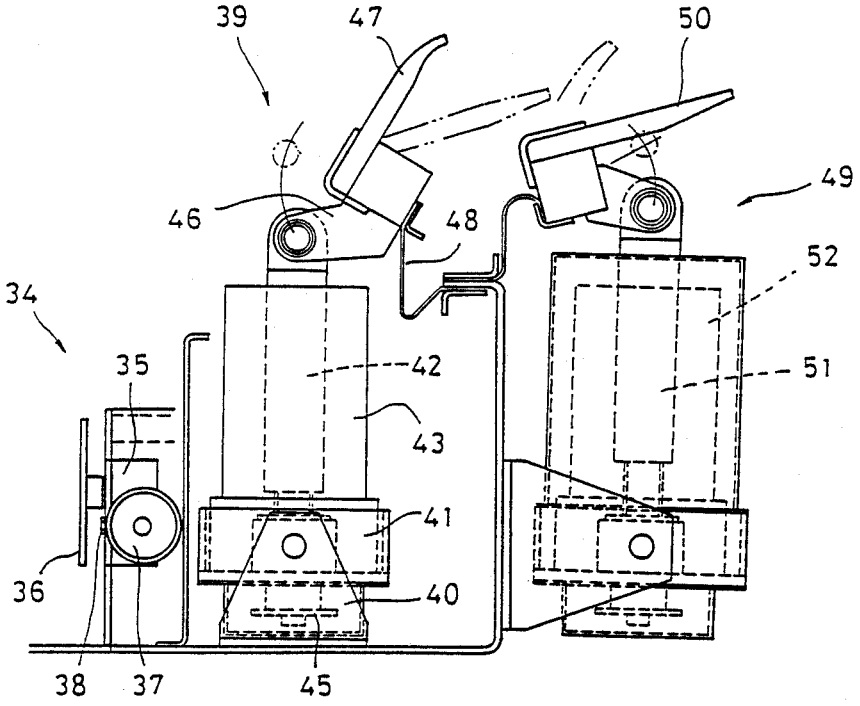
FIG. 5 is a plan view of the water spray device and a wiper structure.
Figure 6:
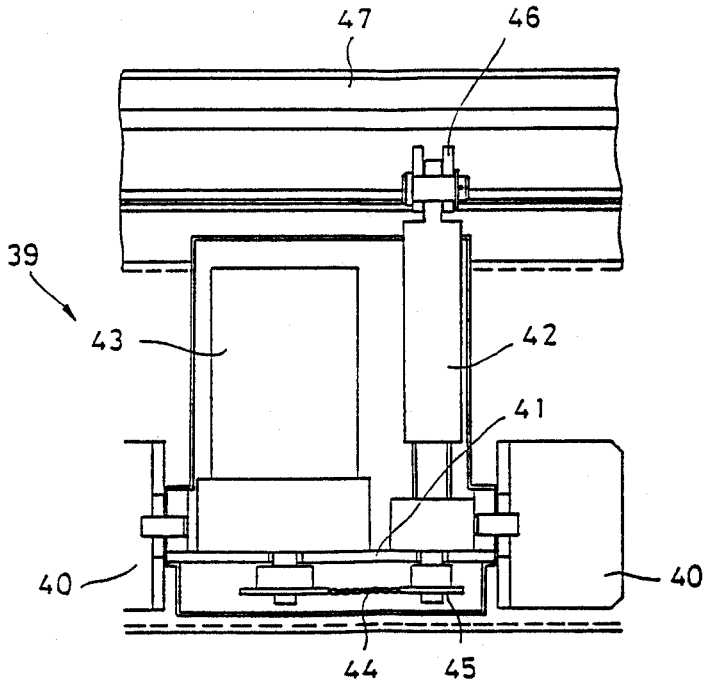
FIG. 6 is a right side view of the wiper structure.

In the illustrated embodiment, four water spray devices 34 are disposed vertically and equidistantly in the work carrier 15 so that they will spray water uniformly over the surface of the window glass 10. As shown in FIGS. 4 and 5, each water spray device 34 comprises a rotary disk 36 which is coupled to a motor 35 and is rotated thereby. The rotation shaft of the rotary disk 36 is inclined in such a manner that the rotation shaft on the side of the rotary disk 36 is slightly lowered from a horizontal plane. A water spray tube 38 having a flow control valve 37 is provided above the rotary disk 36. Water dripping from the water spray tube 38 drops at a position of the rotary disk 36 above the central portion of the rotary disk 36.

Accordingly, as water which has been controlled to a predetermined flow quantity by the flow control valve 37 drips on the rotary disk 36, the water is sprayed uniformly over the window glass 10 due to the rotation of the rotary disk 36.

A wiper device 39 is provided at the rear of the water spray devices 34 in the work carrier 15 for wiping off dust and soiled water from the window glass 10. As shown in FIGS. 4 and 5, a mounting frame 41 is secured to a pair of mounting plates 40 provided in the vertically middle portion of the work carrier 15. A screw jack 42 which can approach and withdraw from the window glass 10 is secured to the lower surface of the mounting frame 41. This screw jack 42 is driven by a motor 43 through a chain 44 and a sprocket 45. An arm 46 is pivotably mounted on a pin 81 secured to the free end portion of the screw jack 42. A wiper member 47 made of a flexible material such as EPT rubber of a length which is substantially equal to the height of the window glass 10 is secured in its middle portion to the arm 46. One end portions of springs 48 of a generally L shape are secured to the arm 46 in the longitudinal direction of the wiper member 47 and the other end portions of the springs 48 are secured to a side portion of the carrier 15 to resiliently support the wiper member 47.

Likewise, a wiper device 49 of a similar structure is provided on the rear surface of the work carrier 15 to clean a louver portion of the building. In this wiper device 49, a wiper member 50 is of a length from the lower end to the middle portion of the window glass 10. This wiper member 50 is driven by a screw jack 51 and a motor 52.

Accordingly, the wiper member 47 for cleaning the window glass 10 and the wiper member 50 for cleaning the louver portion can be pushed against a surface to be cleaned and withdrawn therefrom by driving the motors 43 and 52 and thereby stretching and withdrawing the screw jacks 42 and 51.

For collecting soiled water after the cleaning by the wiper device 39, a soiled water pan 53 is provided in the lower portion of the work carrier 15 and the soiled water can be pumped up by a soiled water pump 54.

A fresh water tank 55 containing fresh water used for cleaning is mounted on the upper portion of the main carrier 14 running before the work carrier 15. Fresh water can be supplied to the water spray device 34 by means of a fresh water pump 56. A soiled water tank 57 for containing soiled water supplied from the soiled water pan 53 on the work carrier 15 is mounted in the lower portion of the main carrier 14. Batteries 58 are also mounted on the main carrier 14 for supplying power to the motors in the respective devices. A control device 59 for controlling the entire cleaning device including the running drive device is also mounted on the main carrier 14 and this control device 59 is radio-controlled.

Figure 2:
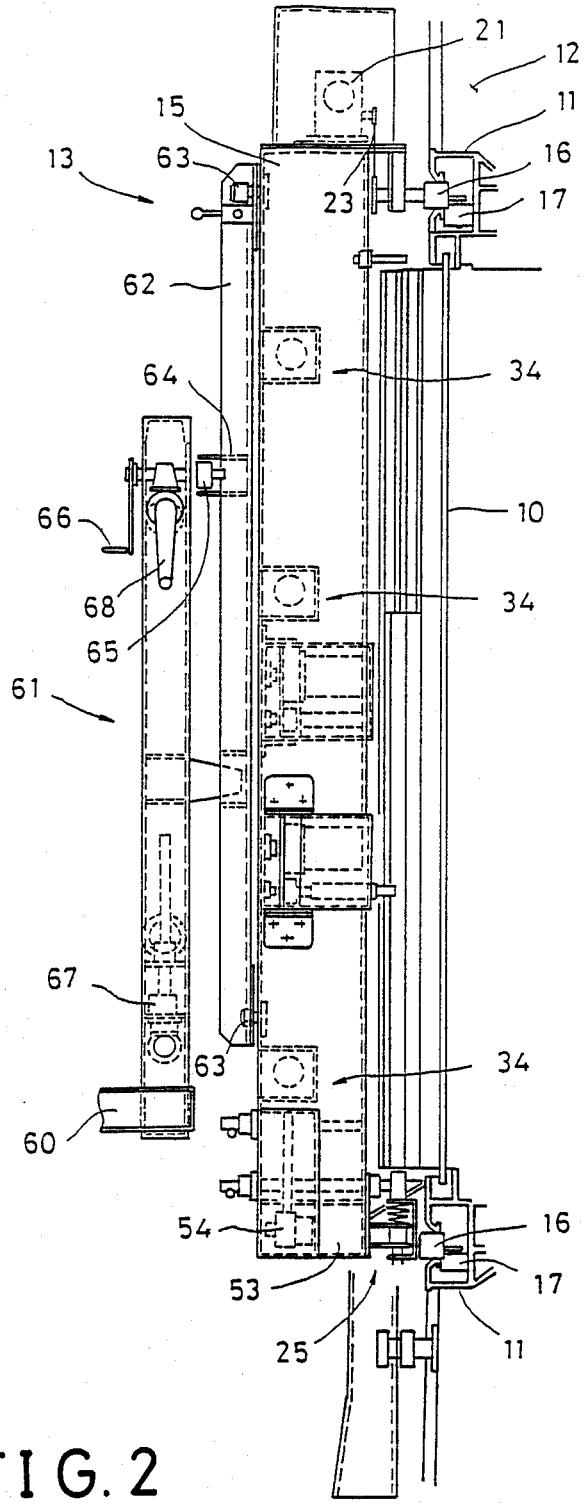
FIG. 2 is a right side view of the embodiment shown with a mounting device.

For mounting the horizontally moving automatic outer surface cleaning apparatus of the above described construction on the horizontal rails 11 of a certain floor of a building, a suitable apparatus such as a gondola hung from the roof is used. A mounting device used for this purpose will be briefly described with reference to FIG. 2.

The horizontal rails 11 are formed with openings from which the running rollers 16 and the guide rollers 17 of the main carrier 14 and the work carrier 15 can be inserted. The carriers 14 and 15 must be mounted with these rollers 16 and 17 being inserted in the openings of the horizontal rails 11.

For this purpose, a mounting device 61 is provided on a support table 60 which is provided on an unillustrated gondola in such a manner that the table 60 projects from the gondola towards the glass window 10. Pins 63 are secured to a mounting frame 62 provided on the window side of the mounting device 61 and these pins 63 are fitted in corresponding openings of the respective carriers 14 and 15 to connect the carriers 14 and 15 to the gondola. An eccentric cam 65 is fitted in an engaging portion 64 formed in about the central portion of the mounting frame 62 and this eccentric cam 65 can be rotated by rotating an angle adjusting handle 66.

The mounting device 61 is provided on the support table 60 through a height adjusting mechanism constructed of a screw jack 67 which can be operated by a height adjusting handle 68. As is well known, the gondola is provided with a stretchable arm (not shown) which can engage with a fixing pin (not shown) provided on the building side for fixing the position of the gondola.

By adjusting the height and angle of the cleaning device by operating the above described mounting device 61, the cleaning apparatus can be mounted on the horizontal rails 11.

After mounting the horizontally moving automatic outer surface cleaning apparatus on the horizontal rails 11, the brushes 31 for cleaning the horizontal rails 11 are driven by the brush drive motor 32 and the running rollers 16 are driven by the running drive motor 21 whereby the main carrier 14 and and the work carrier 15 are moved horizontally in a mutually coupled state.

Simultaneously with running of the carriers 14 and 15, the pump 56 is driven to drip fresh water on the rotary disks 36 through the flow-control valves 37 of the respective water spray device 34 to spray water uniformly on the window glass 10. Further, the wiper members 47 of the wiper device 39 are caused to project to a predetermined position to clean the window glass 10. As the cleaning apparatus is moved, fresh water is sprayed over the window glass 10 and, as a result, dust and soils are continuously wiped off the surface of the window glass 10 by the wiper member 47 and collected in the soiled water pan 53.

Since the running rollers 16 and the guide rollers 17 on the lower side of the carriers 14 and 15 are mounted on these carriers through the suspension 25, the carriers 14 and 15 can be moved smoothly despite a slight variation in the interval of each horizontal rail 11.

In a case where the building has horizontally continuous windows along the entire periphery of the building, the cleaning apparatus must move around corner portions of such horizontally continuous windows. According to the invention, since the cleaning apparatus is composed of the main carrier 14 and the work carrier 15 coupled to each other, the cleaning apparatus can move around these corners without trouble. Beside, since the wiper members 47 are vertically disposed, a thorough cleaning of the window glass 10 can be realized.

In the above described embodiment, a single cleaning apparatus is moved to a desired place by using the gondola and the mounting device. Alternatively, plural cleaning apparatus of this type may be vertically disposed to effect cleaning of window glasses of respective floors. Instead of the gondola, a lifting and lowering device specially designed for exclusive use for this cleaning apparatus may be employed for moving the cleaning apparatus.

In a case where the surface to be cleaned of a window glass or the like is a flat surface, the carrier 13 need not be composed of two carriers coupled together but it may be an integral carrier. In this latter case, the integral carrier may be reciprocated and may be provided with wiper devices on both sides of the water spray device and one of the wiper devices on the rear side in the running direction of the carrier may be used while the carrier is reciprocated so that the cleaning appratus can perform the cleaning operation in both directions with increasing efficiency.

The drive mechanism for the running rollers, the water spray devices and the wiper devices are not limited to those described above but they may be of any construction so long as they can perform functions assigned to them such as running, water spraying and wiping.

The surface which can be the object of cleaning by the cleaning apparatus according to the invention is not limited to the window glass but it may be other surfaces such as a wall surface. The surface is not limited to a flat surface but it may be a surface with a projection such as a sashed window. In this case, a linear horizontal rail is provided along the surface of the projection and the wiper member may be withdrawn in the place where the projection is provided.

In the above embodiment, the respective devices of the cleaning apparatus are driven by batteries so that they may be radio-controlled. Alternatively, these devices may be supplied with power from a power source disposed on the roof by means of a wire and the devices may be controlled by means of a control cable.

What is claimed is:

1. A horizontal moving automatic outer surface cleaning apparatus comprising;

horizontal rails provided above and below a surface to be cleaned of a building;

a carrier having means for engaging said horizontal rails for enabling said carrier to be guided along said rails; and carrier mounting means for mounting said carrier on said horizontal rails, said carrier mounting means comprising:

a mounting frame provided on the side of said carrier mounting means facing the surface to be cleaned;

connecting means provided on said mounting frame and on said carrier for connecting said mounting frame to said carrier;

angle adjusting means operatively connected to said mounting frame for variably adjusting the angle of said carrier with respect to the surface to be cleaned; and height adjusting means operatively connected to said mounting frame for adjusting the height of said carrier with respect the surface to be cleaned, said carrier comprising;

drive means for driving said carrier along said horizontal rails;

cleaning fluid spray means for spraying a cleaning fluid over the surface to be cleaned;

wiper means mounted in the rear of said cleaning fluid spray means in the moving direction of said carrier for cleaning the surface to be cleaned, and means for containing soiled cleaning fluid collected as a result of wiping by said wiper means.

2. A cleaning apparatus as defined in claim 1 wherein said connecting means comprises pins secured to said mounting frame and corresponding openings in said carrier for receiving said pins.

3. A cleaning apparatus as defined in claim 2 wherein said angle adjusting means comprises a rotatable eccentric cam means adapted to be fitted in a cam means engaging portion in said mounting frame and angle adjusting handle means for rotating said eccentric cam means.

4. A cleaning apparatus as defined in claim 3 wherein said height adjusting means comprises a screw jack and height adjusting handle means for operating said screw jack.

5. A cleaning apparatus as defined in claim 4 wherein said horizontal rails comprise channel-shaped openings formed by opposed lip portions, said engaging means of said carrier comprising running rollers in movable contact with said lip portions, guide rollers movable within the horizontal rail and in operative engagement with said channel-shaped openings, and suspension means operatively connected to said running rollers provided in the lower portion of said carrier, said suspension means comprising bracket means operatively connected to said carrier and projecting toward said horizontal rails, vertical support rod means displaceably mounted on said bracket means, a support frame secured to said vertical support rod means and enclosing said bracket means and spring means provided between said bracket means and said support frame.

6. A cleaning apparatus as defined in claim 5 wherein said water spray means comprises a rotary disk, a motor coupled to said rotary disk through a rotation shaft for rotating said rotary disk, the portion of the rotation shaft on the side of the rotary disk being inclined downward from a horizontal plane, and a cleaning fluid supply tube operatively connected to a source of cleaning fluid and mounted to the cleaning apparatus above the rotary disk and adapted to provide a flow of dripping cleaning fluid downward to the rotary disk to a position above the central portion of the rotary disk.

7. A cleaning apparatus as defined in claim 1 wherein said angle adjusting means comprises a rotatable eccentric cam mounting frame and angle adjusting handle means for rotating said eccentric cam means.

8. A cleaning apparatus as defined in claim 1 wherein said height adjusting means comprises a screw jack and height adjusting handle means for operating said screw jack.

9. A cleaning apparatus as defined in claim 1 wherein said horizontal rails comprise channel-shaped openings formed by opposed lip portions, said engaging means of said carrier comprising running rollers in movable contact with said lip portions, guide rollers movable within the horizontal rails and in operative engagement with said channel-shaped openings, and suspension means operatively connected to said running rollers provided in the lower portion of said carrier, said suspension means comprising bracket means operatively connected to said carrier and projecting toward said horizontal rails, vertical support rod means displaceably mounted on said bracket means, a support frame secured to said vertical support rod means and enclosing said bracket means and spring means provided between said bracket means and said support frame.

10. A cleaning apparatus as defined in claim 1 wherein said water spray means comprises a rotary disk, a motor coupled to said rotary disk through a rotation shaft for rotating said rotary disk, the portion of the rotation shaft on the side of the rotary disk being inclined downward from a horizontal plane, and a cleaning fluid supply tube operatively connected to a source of cleaning fluid and mounted to the cleaning apparatus above the rotary disk and adapted to provide a flow of dripping cleaning fluid downward to the rotary disk to a position above the central portion of the rotary disk.

11. A cleaning apparatus as defined in claim 1 wherein the drive means is rigidly fixed to the carrier.

* * * * *